US006952549B2

(12) United States Patent
Kato et al.

(10) Patent No.: US 6,952,549 B2
(45) Date of Patent: Oct. 4, 2005

(54) DEVELOPER SUPPLY APPARATUS AND DEVELOPER SUPPLY CONTAINER

(75) Inventors: Takayuki Kato, Kashiwa (JP); Akihiro Shimizu, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 76 days.

(21) Appl. No.: 10/444,115

(22) Filed: May 23, 2003

(65) Prior Publication Data

US 2004/0009016 A1 Jan. 15, 2004

(30) Foreign Application Priority Data

May 24, 2002 (JP) ..... 2002-151027

(51) Int. Cl.[7] ..... G03G 15/08
(52) U.S. Cl. ..... 399/260; 399/106
(58) Field of Search ..... 399/106, 111, 399/258, 260, 262; 222/DIG. 1; D18/43

(56) References Cited

U.S. PATENT DOCUMENTS 4,371,015 A 2/1983 Simons ..... 141/352
5,890,040 A * 3/1999 Matsuoka et al. ..... 399/262
6,185,401 B1 * 2/2001 Kanamori et al. ..... 399/262
2002/0127029 A1 * 9/2002 Yamada et al. ..... 399/106

FOREIGN PATENT DOCUMENTS

DE 3343910 A1 6/1984
JP 2-47678 2/1990

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

A developer supply apparatus includes a holding member for detachably holding a developer supply container having a developer discharge opening and a sealing member for sealing the developer discharge opening; a rotatable member rotatably supported on the holding member; a converting mechanism, provided at a connecting portion between the rotatable member and the holding member, for converting a rotation of the rotatable member to a sliding operation of the holding member; wherein the sealing member moves from a closing position to an opening position by the sliding operation.

11 Claims, 9 Drawing Sheets

PRIOR ART (A)

PRIOR ART (B)

PRIOR ART (C)

DEVELOPER SUPPLY APPARATUS AND DEVELOPER SUPPLY CONTAINER

FIELD OF THE INVENTION AND RELATED ART

The present invention relates to a developer supply apparatus and a developer supply container usable with a copying machine, a printer, a facsimile machine or the like using an electrophotographic type, electrostatic recording type or the like process.

In an electrophotographic image forming apparatus such as a copying machine, a printer or the like, toner comprising fine particles is used as a developer. When the toner in the main assembly of the electrophotographic image forming apparatus is consumed, the toner is supplied into the main assembly of the image forming apparatus using a toner bottle (toner supply container). Since the toner is very fine powder, it is known to place, in a toner supplying operation, a toner supply container inside the main assembly of the image forming apparatus and to gradually supply the toner through a small opening to avoid scattering of the toner.

Referring to FIG. 1 there is shown a substantial front view of the main assembly of an image forming apparatus. The toner discharged from the toner bottle 1 is once accommodated in a hopper 24 (accommodating means), and then is supplied into the developing device 11.

FIGS. 7(A) through 7(C) show a toner supply device 700 mountable to the main assembly of the apparatus. The toner supply device 700 is provided with a driving portion (driving force transmitting portion) 20, connectable with the toner bottle 1, for rotating the toner bottle 1. The driving portion 20 is rotatably supported by bearings 23, and is rotated by an unshown driving motor provided in the main assembly 100 of the apparatus. The hopper 24 is constituted by a wall 25, which is provided with inner and outer bearings 26*a*, 26*b* for rotatably supporting a part of the toner bottle 1 and for sealing the hopper 24. In the hopper 24, there is provided a screw for feeding the supply toner into the developing device 11.

FIG. 7, (A) illustrates mounting of the toner bottle 1 to the main assembly 100 of the apparatus.

One end surface at a leading end of the toner bottle 1, there is provided a toner discharge opening (opening) 1*a*, and the opening 1*a* is sealed by a sealing member 2 at the end of the opening.

FIG. 7, (B) shows a state in which the toner bottle 1 is advanced in the direction indicated by an arrow a by the operation of the holding member (holding member) to such an extent that engaging projection 3 (locking projection) provided at the end of the sealing member 2 is brought into engagement with a locking hole of a driving portion 20 of the main assembly of the apparatus.

After the sealing member 2 and the driving portion 20 are engaged with each other, the bottle holding member 600 is retracted in the direction indicated by an arrow b, by which the toner bottle 1 is retracted too. However, the sealing member 2 is fixed by locking with the main assembly side of the image forming apparatus, so that sealing member 2 is relatively moved away from the toner bottle 1, and the opening 1*a* is unsealed or opened. FIG. 7, (C) shows this state. When an unshown motor is driven in this state, the rotational driving force is transmitted to a driving force receiving surface of the engaging projection of the sealing member 2 from the main assembly driving portion 20, and the driving force is transmitted from the sealing member 2 to the driving shaft 1*b*, which rotates the toner bottle 1 to feed and discharge the toner. Thus, the sealing member 2 has a function of sealing the opening 1*a*, a function of receiving the rotational driving force from the main assembly side of image forming apparatus, as a function of transmitting the rotational driving force to the toner bottle 1 side.

By such a rotation of the toner bottle 1, the toner accommodated in the toner bottle 1 is discharged gradually through the opening 1*a*, and is fed into the developing device 11 by a screw member 27 provided in the hopper 24, so that toner supply is carried out. When the toner bottle 1 which has become empty, is taken out of the main assembly of the apparatus, the process is reversed (from FIG. 7(C) to (A)).

In this manner, when the toner accommodating container (toner bottle) 1 is mounted to or demounted from the main assembly of the apparatus, the bottle has to be reciprocated along the direction of the rotational axis of the toner bottle 1 (arrow an or b direction). In view of the easy exchange of the toner bottle 1, the structure may be such that user operates from the position of FIG. 7, (A) to the position FIG. 7, (B), and the operation of (C) is carried out in interrelation with the closing action of the door for the toner bottle exchange, or it may be such that all the operations from (A) to (C) are carried out in interrelation with the motion of the exchange door.

The following discussion provides examples of the mechanisms for effecting the reciprocal linear motions of the toner bottle 1 and a bottle holding member 600. FIG. 8 is a perspective view of the bottle holding member 600 as seen from the bottom, and the unshown toner bottle is placed on the back side in the Figure. A rotation shaft 51 exposed to the exchange door (unshown) is rotated in the direction indicated by an arrow h through a gear train (52*a*–52*f*) by rotation of a rotational link 53 in the direction indicated by an arrow k in the Figure. The rotation of the rotational link 53 moves a slide link 54 and linearly reciprocates the bottle holding member 600 in the direction indicated by an arrow through a projection 600*a* engaged with the slide link 54.

FIG. 9 is a perspective view of the bottle holding member 600 as seen from the bottom similarly to FIG. 8, and the unshown toner bottle is placed on the back side of the Figure. The rotating operation of the rotation shaft 51 in the direction indicated by an arrow h rotates a guiding cam 55 which integrally rotates with the rotation shaft 51. The induction cam 55 has a groove portion in which a projection 600*a* of the bottle holding member 600 is engaged, so that rotation of the induction cam 55 in the direction indicated by an arrow h is converted to a linear reciprocating motion to operate the bottle holding member 600.

In another example, the rotation of the rotation shaft 51 (FIGS. 8 and 9) is not interrelated with the exchange door, and an unshown grip is provided on the rotation shaft 51, wherein the bottle holding member 600 is linearly reciprocated by the user.

However, with such structures, the following problems arise.

It is a recent demand to an image forming apparatus that apparatus is downsized, that cost is reduced and that operation is easy from the standpoint of users. In the case that toner bottle and/or the bottle holding member is linearly reciprocated as shown in FIG. 8, the use is made with a plurality of gear trains 52*a*–52*f* and/or link members (53, 54), and therefore, the number of parts increases with the result of cost increase. To the portions which the user directly touch, unexpected and unavoidable forces may be applied unintentionally. If this occurs, the teeth of the gear may be broken, or the surfaces of the teeth may be damaged due to tilting of the rotational shaft of the gear 52*f*, for example. In order to avoid reduction in the reliability attributable to them, some reinforcement for prevention of the shaft tilting or change of the gear material may be added with the result of increase in cost. When the mechanism is constituted by a gear train and a link, it is required to align a rotational position phase of the rotation shaft 51 and the positional phase of the bottle holding member 600 with each other, and this will further increase the cost.

In the case of the mechanism shown in FIG. 9, the cost increase by the increase in the number of parts and the adjustment and assembly is smaller than in the case of FIG. 8. However, the diameter of the induction cam 55 has to be larger from the standpoint of reducing the force required to the user. As a result, the downsizing of apparatus is difficult.

SUMMARY OF THE INVENTION

Accordingly, it is a principal object of the present invention to provide a developer supply apparatus with which a sliding movement of the developer supply container is accomplished with a simple structure and without significant upsizing or cost increase. It is another object of the present invention to provide a developer supply apparatus with which an unsealing operation and/or a sealing operation is accomplished with a simple structure and without significant upsizing or cost increase.

It is a further object of the present invention to provide a developer supply container with which a sliding movement of the developer supply container is accomplished with a simple structure and without significant upsizing or cost increase.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

In the following descriptions, the dimensions, materials, configurations, relative position on relationships of elements constituting the apparatus of this invention are not limiting the present invention, except for particular mentioning to the effect.

Figure 1:
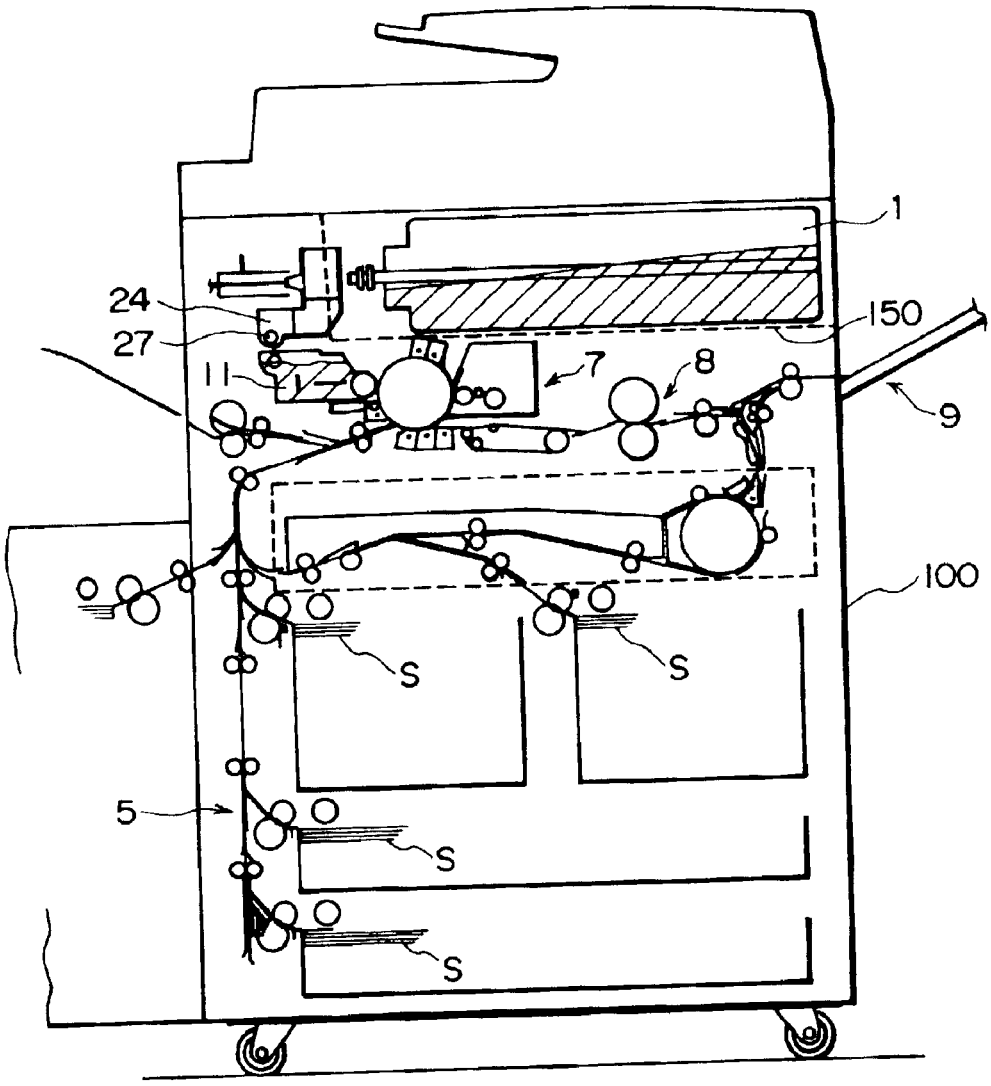
FIG. 1 is a substantial front view of a main assembly of an image forming apparatus.

Referring to FIG. 1, there is shown a substantial front view of the main assembly of an image forming apparatus. The toner bottle (developer supply container) 1 is placed horizontally, and toner (developer) discharged from the toner bottle 1 is temporarily accommodated in the hopper 24 (accommodating means), and then is fed into the developing device (developing means) 11. The toner fed into the developing device 11 is applied to a photosensitive drum 6 (image bearing member) at an image forming station 7 to form a toner image. On the other hand, a transfer material S fed from the feeding means 5 receives a toner image formed in the image forming station 7, is passed through a fixing device 8 by which the toner image is fixed on the transfer material S and then is discharged to a discharging tray 9.

FIGS. 2(A) through 2(C) schematically show a toner supply device 400 mountable to the main assembly of the apparatus. The toner supply device 400 is provided with a driving portion (driving force transmitting portion) 20 connectable with the toner bottle 1 to rotate the toner bottle 1. The driving portion 20 is rotatably supported (unshown), and is rotated by an unshown driving motor provided in the main assembly 100 of the apparatus. A hopper 24 includes a screw member 27 to feed the supply toner into the developing device 11.

Figure 2:
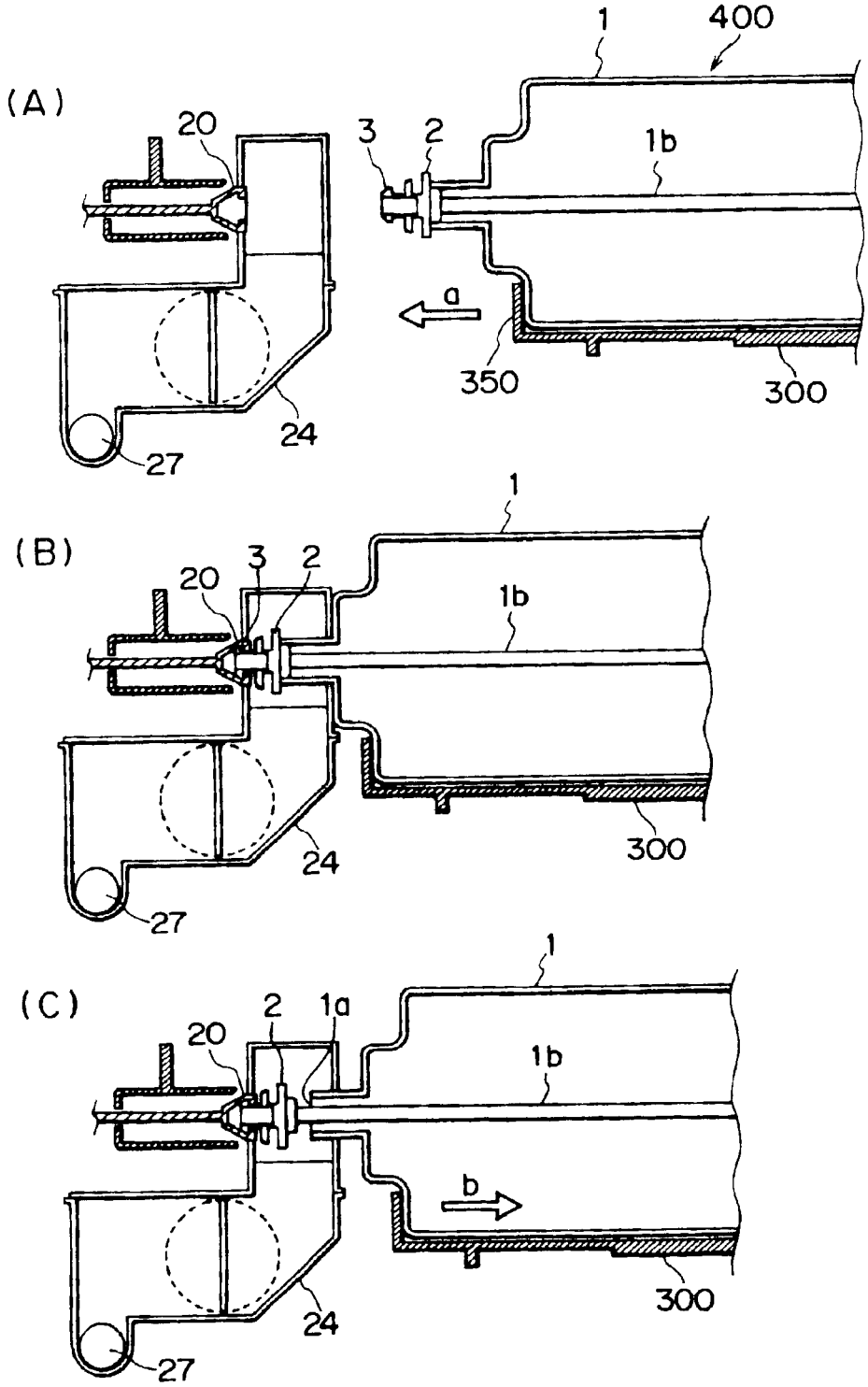
FIGS. 2(A) through 2(C) are substantial front views of a toner supply device mountable to the main assembly of the apparatus.

FIG. 2, (A) shows a state in which the toner bottle 1 is being mounted to the toner supply device 400. In the state shown in (A) of FIG. 2, the toner bottle 1 is not connected with the driving portion 20, and therefore, the user can mount or demount the toner bottle 1 relative to the toner supply device 400. However, when the toner bottle 1 is mounted, the toner bottle 1 is prevented from moving in the directions indicated by arrows a, b by a pair of position regulating member 350 provided in the bottle holding member 300. In FIG. 2, only one of the position regulating members constituting the pair is shown, but an additional position regulating member having the same structure is provided at the other side of the toner bottle 1 (right hand side in FIG. 2), which is omitted for simplicity.

As will be described hereinafter, the toner bottle 1 makes a sliding motion substantially integrally with the slide motion of the bottle holding member 300. In view of easiness of the mounting and demounting of the toner bottle 1, there is provided a play, and the toner bottle 1 is movable in the directions indicated by arrows a, b by the amount of the play.

One end surface of a leasing end of the toner bottle 1 with respect to the toner bottle mounting direction, is provided with a toner discharge opening (opening) (FIG. 2, (C)), and the opening 1*a* is sealed by a sealing member 2.

Figure 3:
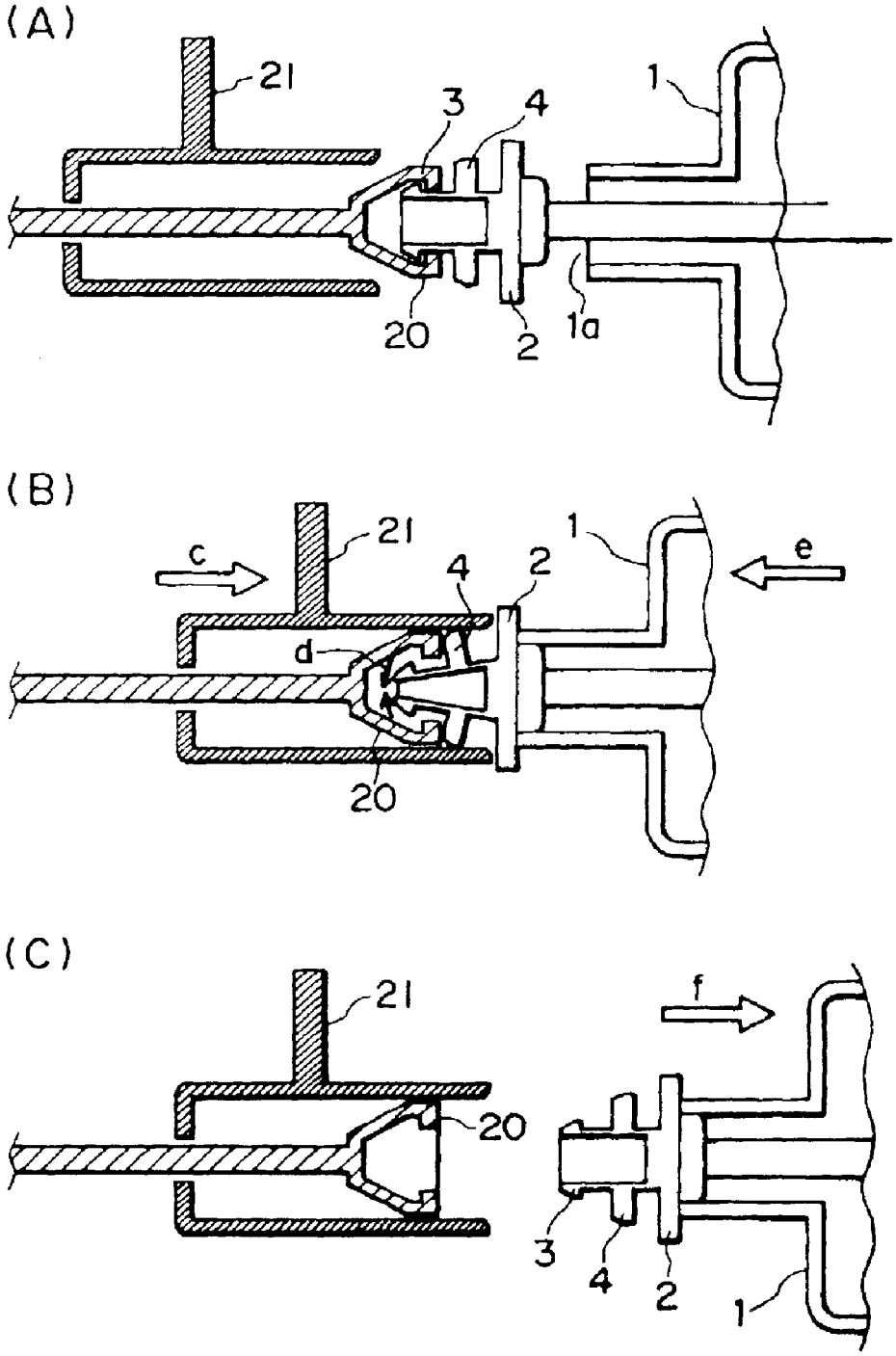
FIGS. 3(A) through 3(C) are detailed illustrations of a sealing member and a driving portion.

FIG. 2, (B) shows a state in which the bottle holding member (holding member) 300 has been moved in the direction indicated by arrow a, so that toner bottle 1 has moved toward the driving portion 20, and wherein an engaging projection 3 (locking projection) provided at a leading end of the sealing member 2 have been brought into engagement with a locking hole of a driving portion 20 (FIG. 3 is a detailed illustration). The engaging projection 3 is locked by elastic snap fitting into the locking hole of the driving portion 20 by the relative sliding motion between the sealing member 2 and the driving portion 20.

Figure 7:
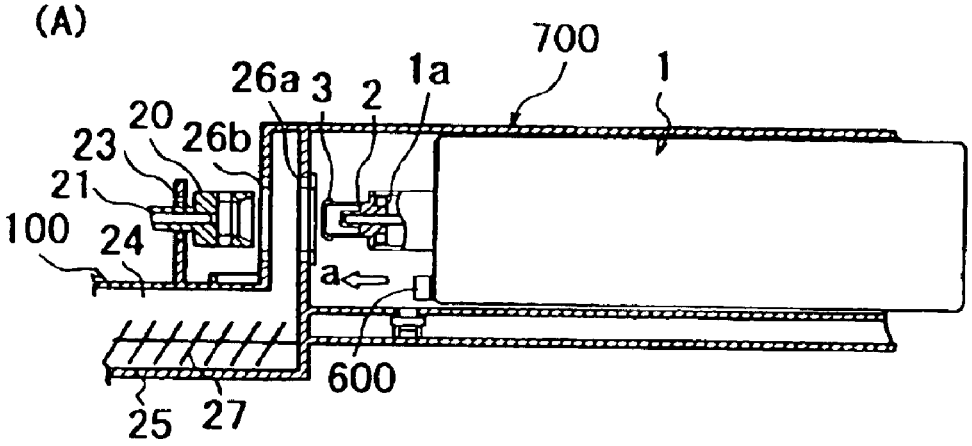
FIGS. 7(A) through 7(C) a conventional toner supply device.
Figure 7:
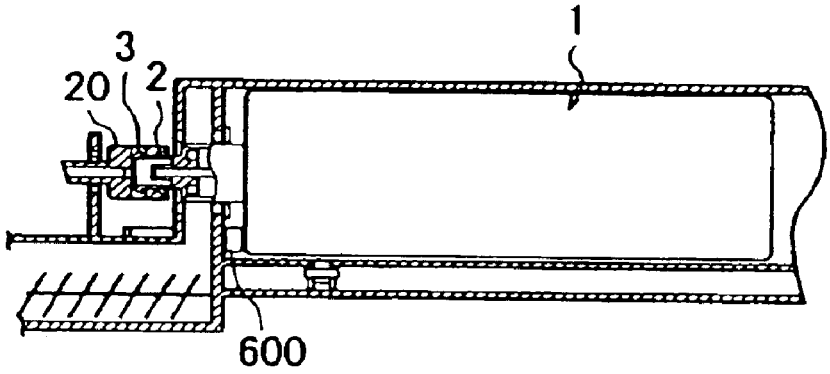
Figure 7:
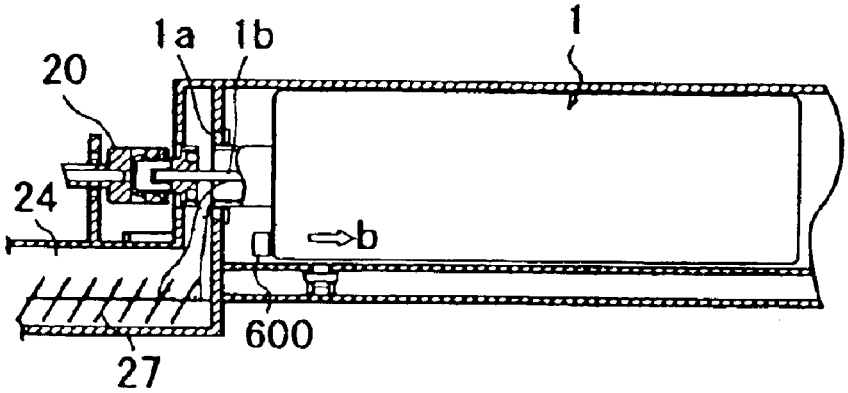
Figure 8:
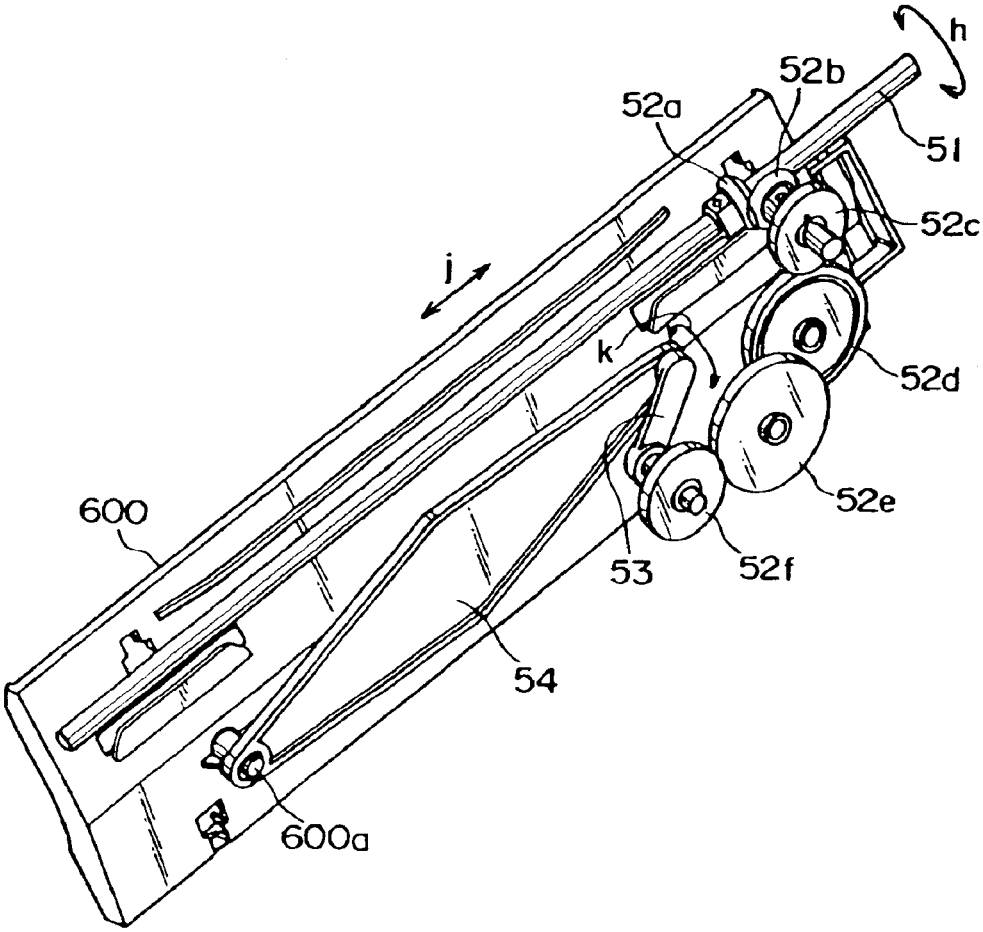
FIG. 8 PRIOR ART
FIG. 8 is a perspective view of the conventional bottle holding member as seen from the bottom.
Figure 9:
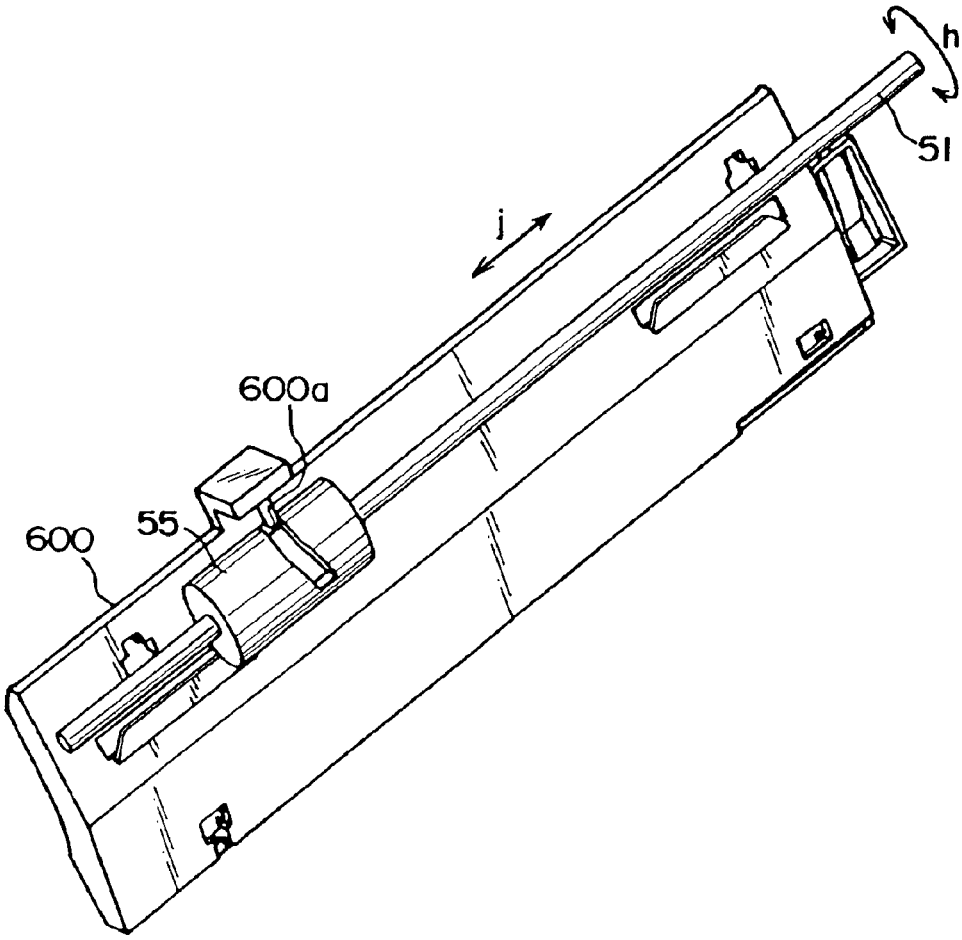
FIG. 9 PRIOR ART
FIG. 9 is a perspective view of the conventional bottle holding member as seen from the bottom.

After the sealing member 2 and the driving portion 20 are engaged with each other, the bottle holding member 300 is retracted in the direction indicated by an arrow b, by which the toner bottle 1 is retracted too. However, the sealing member 2 is fixed by locking with the main assembly side of the image forming apparatus, so that sealing member 2 is relatively moved away from the toner bottle 1, and the opening 1*a* is unsealed or opened. FIG. 7, (C) shows this state. In other words, the sealing member is automatically removed. As will be described hereinafter, the opening is automatically resealed by the sealing member.

When an unshown motor is driven in this state, the rotational driving force is transmitted to a driving force receiving surface of the engaging projection of the sealing member 2 from the main assembly driving portion 20, and the driving force is transmitted from the sealing member 2 to the driving shaft 1*b*, which rotates the toner bottle 1 to feed and discharge the toner. Thus, the sealing member 2 has multiple functions. Firstly, it functions to seal the opening 1*a*, and to receive a rotational driving force from main assembly side of the image forming apparatus. Additionally, it functions to transmit the rotational driving force to the toner bottle 1 side. By rotation of the toner bottle 1 through the sealing member 2, the toner contained in the inside of the toner bottle 1 is gradually discharged through the opening 1*a*, and is fed into a developing device 11 (FIG. 1) by a screw member 27 provided in the hopper 24, thus effecting the toner supply.

FIGS. 3(A) through 3(C) illustrate details of the sealing member 2 and the driving portion 20. FIG. 3, (A) is an enlarged view of FIG. 2, (C). As a result of operation described in conjunction with FIGS. 2, (B) and (C), the locking projection 3 provided at the leading end portion of the sealing member 2 is locked in the locking hole of the driving portion 20 o the main assembly side of the apparatus, and by the slide movement of the toner bottle 1 held on the bottle holding member 300, the opening 1*a* is unsealed, so that toner supply is enabled.

When the snap fit locking between the main assembly driving portion 20 and the sealing member 2 is to be released, a cylindrical opening and closing control member 21 (releasing member) which has a tapered inside peripheral surface is advanced in the direction indicated by an arrow c toward the releasing projections 4 provided at the free end portion of the sealing member 2. The releasing projections 4 are pushed radially inwardly by the inside peripheral surface of the opening and closing control member 21 to displace elastically in the direction indicated by arrow d so that engaging projection 3 simultaneously moves inwardly together with the releasing projection 4. By this, the engagement between the engaging projection 3 and the main assembly driving portion 20 is released.

On the other hand, the toner bottle 1 is moved in the direction indicated by an arrow e, and therefore, the opening 1*a* of the toner bottle 1 held on the bottle holding member 300 Is sealed by the sealing member 2. When the sealing member 2 is in engagement with the driving portion 20 shown in FIG. 2, (B), the opening and closing control member 21 is retained at the position shown in FIG. 3, (A).

Thereafter, as shown in FIG. 3, (C), when the toner bottle 1 held on the bottle holding member 300 with the opening and closing control member 21 retained, is slid in the direction indicated by an arrow f which is the opposite to the above-described direction, the locking between the sealing member 2 and the driving portion 21 is released, so that dismounting of the toner bottle 1 is enabled with that state in which the opening 1*a* is resealed by the sealing member 2. In other words, the user can safely take the toner bottle 1 out of the toner supply device 400.

In this embodiment, the control member 21 stops after the above-described sliding operation in the direction indicated by the arrow c, and then the toner bottle 1 held on the bottle holding member 300 is slid by which the opening 1*a* is sealed, and the toner bottle 1 is retracted in the direction indicated by arrow e. However, in another embodiment, the sliding movement of the control member 21 may be continued in the direction indicated by arrow c, so that after the resealing, it pushes the direction in the direction indicated by arrow f.

As described in the foregoing, simply by rotating the operation cam, the toner bottle 1 held on the bottle holding member and the opening and closing control member 21 can be reciprocally slid along the axis of the toner bottle (the directions of the arrows a, b in FIG. 2). In other words, by the simple cam rotation operation, the unsealing operation of the opening 1*a* of the toner bottle 1, the setting operation for setting the toner bottle from the exchange position where the toner bottle is removable to the supply position where the toner supply is possible, the resealing operation of the opening 1*a* of the toner bottle, and the retracting operation of the toner bottle 1 from the supply position back to the exchange position.

In consideration of the easy bottle exchanging operation of the user, all or a part of the operations of the toner bottle 1 and the operations of the control member 21 operation may be interrelated with opening and closing operations of the exchange door 150 (indicated by broken lines in FIG. 1) provided in the main assembly 100 of the apparatus. In such a case, the exchange door may be rotatable about a hinge disposed at a front side of the bottle 1, and the user can access the toner supply device through the space provided by opening the door, and can mount or demount the bottle. In another example, the operations may be interrelated with an operation grip (unshown) for the user. In a further example, a driving member such as a motor is additionally provided, all or a part of the operations may be automatically carried out in response to a driving control signal from a control device (CPU) provided in the main assembly.

A description will be made as to a mechanism of an inducing member (operation cam which will be described hereinafter) for inducing reciprocal sliding operations of the toner bottle 1 held on a holding member 300 and the opening and closing control member 21. In this example, the reciprocal operations of the toner bottle 1 and the opening and closing control member 21 are sequentially carried out by operating a user grip which is operatively associated with an operation cam.

Figure 4:
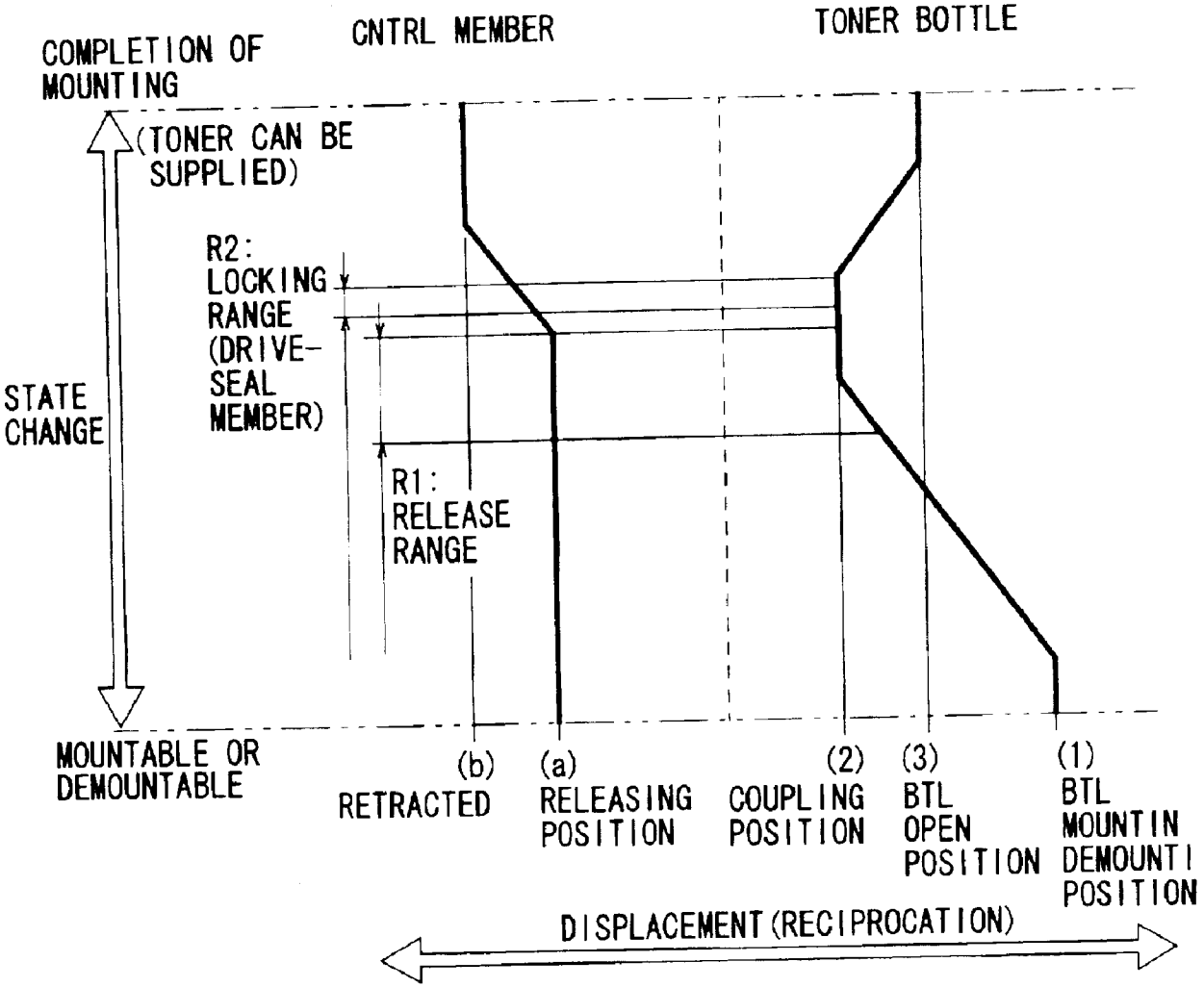
FIG. 4 shows displacements of a toner bottle and an opening and closing control member in the direction of a rotational axis of the toner bottle.

FIG. 4 shows displacements (track) of the toner bottle 1 and the control member 21 in the direction of the axis of the toner bottle in the motion of the toner bottle between the bottle exchange position and the supply position (the set position where the toner can be supplied).

The opening and closing control member 21 is at a position (a) where it is in the released state when the bottle is at the exchange position where the toner bottle is demountable and mountable. In the process toward the set position of the toner bottle, it advances to the left in the Figure to the retracted position. In the process from the set position to the exchange position, the track is opposite.

On the other hand, the toner bottle 1 is placed at the bottle detachably mountable position (exchange position); it moves, in the process of movement toward the set position, leftwardly to the driving portion connecting position (2). After it stops, it moves back to the right, and after the bottle is set in the set position, it is at the bottle opening position (3). In the process from the set position to the exchange position, the track is opposite.

The relations of the various elements in the tracks of the bidirectional motions will be described in more detail. At the beginning of the process of the motion of the toner bottle from the exchange position to the set position, the toner bottle is at the mountable and demountable position where the user can freely mount or demount the toner bottle 1 relative to the main assembly of the apparatus. Thereafter, the toner bottle 1 is moved to a driving portion connecting position, and is at rest there for a predetermined time. The position of the toner bottle at this time corresponds to FIG. 2, (B). At the time when the toner bottle starts stopping at the driving portion connecting position (releasing range R1 in the Figure), the opening and closing control member 21 is at the releasing position (a) (FIG. 3, (B)), and therefore, the locking of the sealing member 2 with the driving portion 21 is not completed. Then, the opening and closing control member 21 moves toward the retracted position (b) while the toner bottle 1 is retained at the driving portion connecting position (2). By this, releasing projection 4 of the sealing member 2 is released, so that locking of the sealing member 2 relative to the driving portion 21 is completed in the locking range R2 in the Figure. Thereafter, the toner bottle 1 moves rightwardly to the bottle opening position (3), where the sealing member 2 is moved away from the toner bottle 1 so that opening 1*a* is unsealed (FIG. 3, (A); FIG. 2, (C)).

On the other hand, in the process from the set position to the mounting and demounting position, the toner bottle 1 moves from the bottle opening position (FIG. 3, (A)) where the opening 1*a* is open to the driving portion connection position (2) where the opening 1*a* is sealed. Then, the opening and closing control member 21 moves to the releasing position (a). While it is retained there (in releasing range R1), the toner bottle 1 moves back to the bottle mounting and demounting position. As a result, the toner bottle 1 can be moved to the bottle mounting and demounting position with the sealing member 2 being disengaged from the driving portion 20 (from the state of FIG. 3, (B) to the state (C)).

Figure 5:
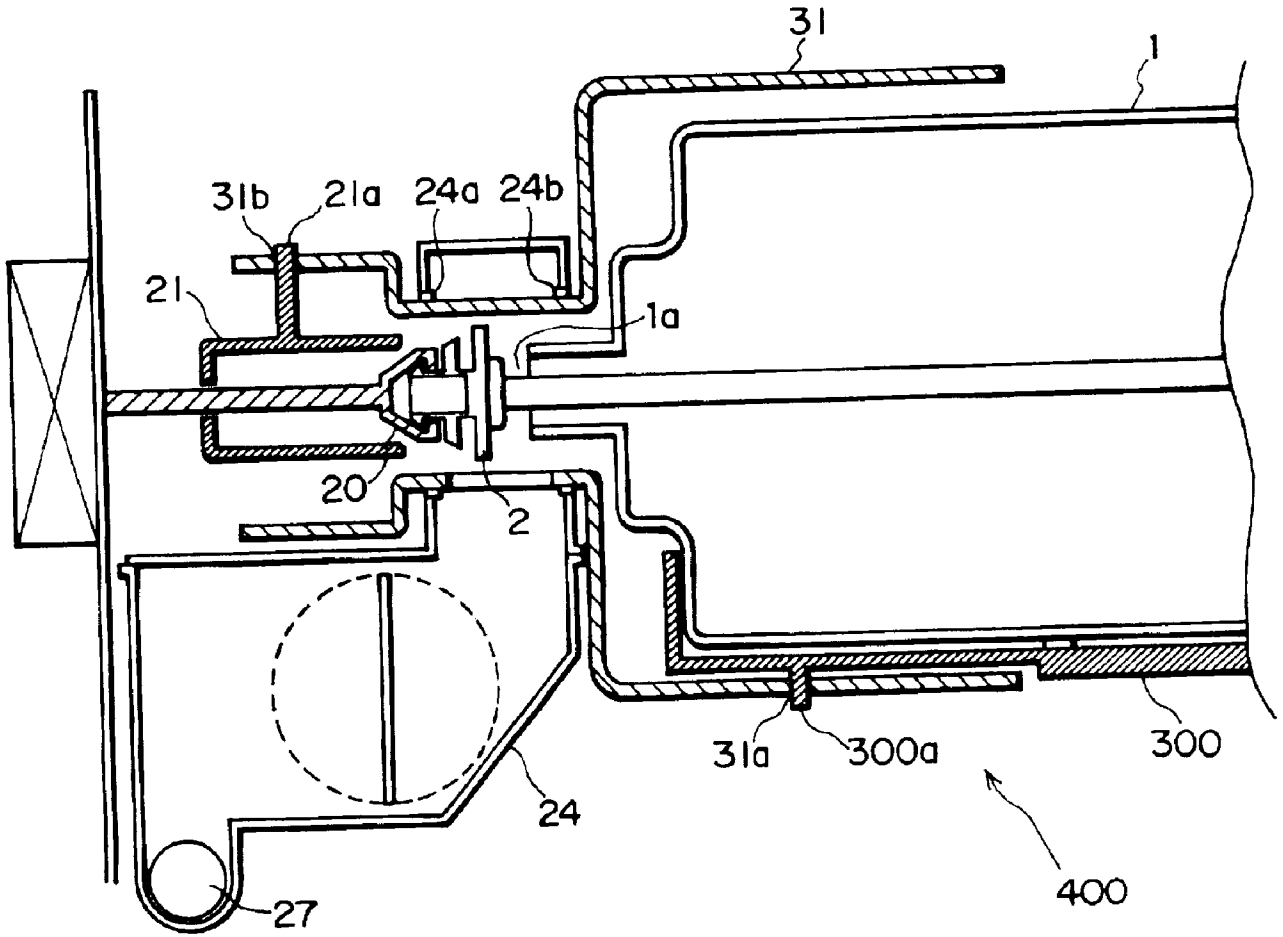
FIG. 5 is a schematic sectional view of an operation cam mechanism.

FIG. 5 is a schematic sectional view illustrating a mechanism for linearly reciprocating the opening and closing control member 21 and the toner bottle 1. The bottle holding member 300 for holding or supporting the toner bottle 1 is operatively associated with a (inducing member) 31 in the form of a rotatable member having a conversion portion, by engagement between an engaging recess 31 *a* of the operation cam and an engaging hole 300 *a* of the bottle holding member. The operation cam extends about a center which is the center of rotation of the toner bottle 1 so as to cover a part of the toner bottle, and the rotation radius is larger than the outer diameter of the toner bottle 1. Thus, the bottle holding member is engaged on the circumference of the operation cam which is larger than the outer diameter of the toner bottle. On the other hand, the opening and closing control member 21 is operatively associated with the operation cam 31 through engagement between the engaging hole 31*b* of the operation cam and the engaging projection 21*a* of the opening and closing control member.

The operation cam 31 is rotatable about the axis of the toner bottle 1, and is rotatably supported by inner and outer bearings 24*a*, 24*b* for substantially hermetically sealing the hopper 24.

Figure 6:
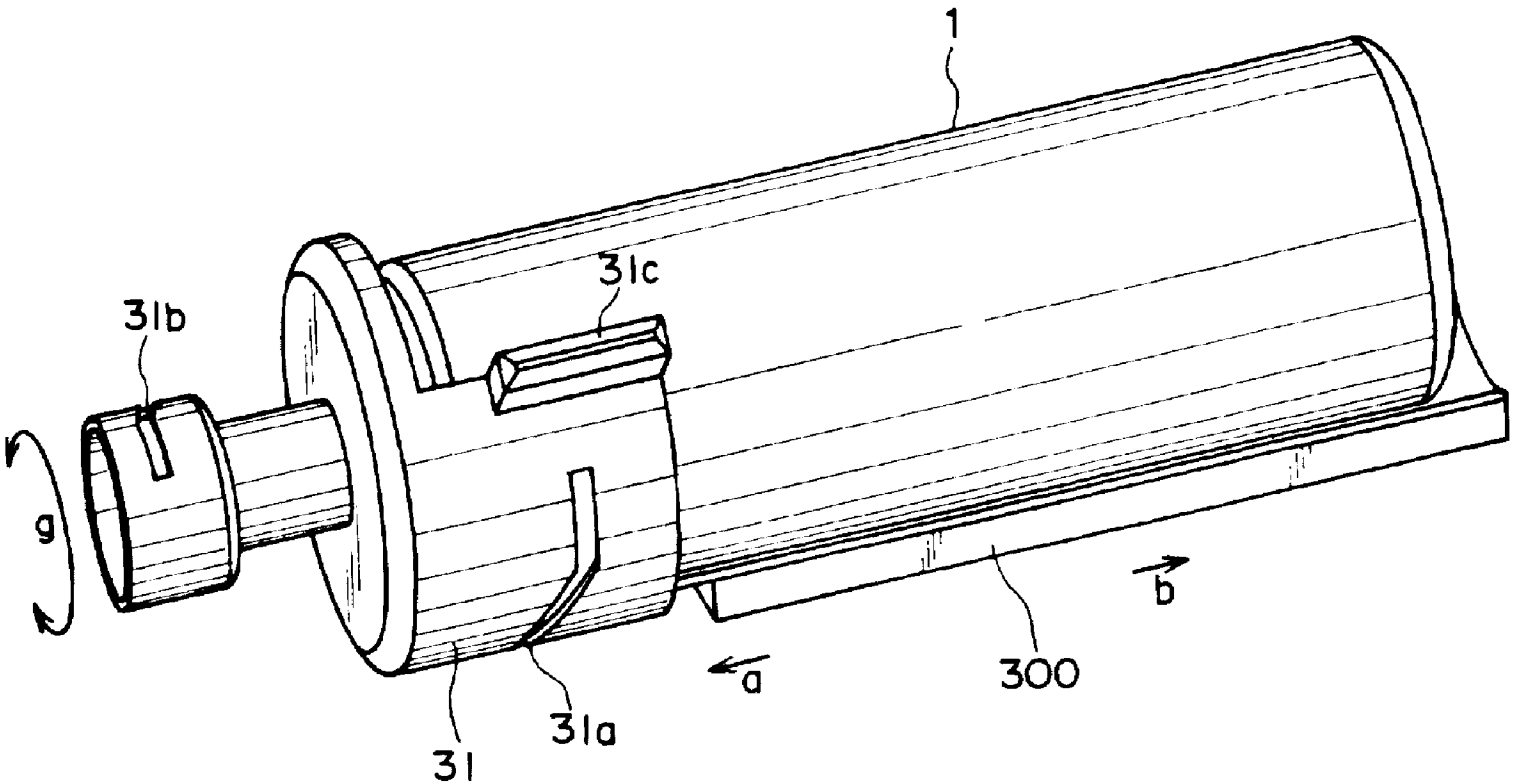
FIG. 6 is a schematic perspective view of the operation cam mechanism.

FIG. 6 is a perspective view schematically illustrating the operation cam 31. The cams are profiled such that setting operation is completed by the user manipulating the operation cam after the user opens the exchange door.

As shown in FIG. 6, the operation cam 31 is provided with a grip portion 31*c* to facilitate the manipulation of the user, the motions between the exchange state and the set state are executed by the users swing rotation of the grip portion 31*c* in the direction indicated by an arrow g.

The engaging portion 31*a* of the engaging portion 31*a* relative to the bottle holding member 300 and the engaging portion 31*b* thereof relative to the opening and closing control member 21 is formed as continuous groove portions extending in circumferential directions to accomplish the phase tracks of the toner bottle 1 and the opening and closing control member 2 which have been shown in FIG. 4. The toner bottle 1 and the control member 21 make the linear reciprocating motions under the control of the groove or cam profiles (31*a*, 31*b*) of the operation cam 31. The linear reciprocating motions of the toner bottle 1 and the control member 21 which have a predetermined relation with each other are determined by the groove configuration (31*a*, 31*b*) of the operation cam, and therefore, adjustment is not necessary during the assembling.

More particularly, by one rotation of the operation cam in one direction, the sliding motions in the opposite directions a, b are realized to complete the unsealing operation and to complete the motion to the set (toner supply) position.

When the toner bottle is to be exchanged with a fresh one, the operation cam is rotated once in the opposite direction, simply by which the sliding motions described in the foregoing in the directions an and b are carried out until the resealing of the toner bottle is completed, and the motion to the toner bottle mounting and demounting (exchanging) position is completed. In this manner, by one simple rotation is enough to complete the unsealing operation, the movement of the bottle to the supply position, the resealing operation and the movement of the bottle to the mounting and demounting position, so that usability is significantly improved.

The members required to accomplish the conversion of the rotations of the operation cam to the linear respective reciprocal movements is substantially only the operation cam 31, and therefore, the necessity for the complicated gear train or link mechanism. This accomplishes significant cost reduction because of the significant reduction of the number of parts.

Simultaneously, the simplification of the converting mechanism makes it easy to prepare for unexpected forces which may be imparted by the user and minimizes the reinforcement. Therefore, the reliability is improved, and the cost can be reduced.

Furthermore, the toner bottle 1 side of the operation cam 31 as a configuration to cover the outer diameter of the toner bottle 1 and is rotatable about the same axes as the toner bottle 1 so that volume required by the operation cam 31 including the moving range thereof is significantly small. This contributes to the downsizing of the main assembly of apparatus, too. In addition, the outer diameter of the operation cam 31 can be made a sufficiently large as compared with the outer diameter of the bottle, so that load required for rotating the operation cam 31, that is, the operation force required for the user to manipulate can be reduced significantly, thus accomplishing the improvement in the usability.

(Other Embodiments)

In the foregoing example, the operation cam 31 is manipulated by the user. However, the present invention is not limited to this example, but can be implemented by interrelating the rotating operation of the operation cam 31 with the opening and closing actions of the exchange door 150. In the foregoing embodiments, both of the toner bottle 1 and the opening and closing control member 21 are reciprocated, but the present invention can be implemented by effecting only the reciprocation of the toner bottle 1 by the inducing member (operation cam) 31 which is rotatable about the rotational axis of the toner bottle 1.

In the foregoing embodiments, the operation cam 31 is manually operated, but the present invention is not limited to this example, and a driving mechanism for driving the operation cam 31 may be provided which is controlled by driving control means such as a CPU. In the foregoing embodiments, the image forming apparatus is in the form of a copying machine, but the present invention is applicable to another apparatus such as a printer or facsimile machine.

According to the foregoing embodiments of the present invention, the unsealing operation of the developer supply container, the operation of moving the developer supply container to the developer supply position, the resealing operation of the developer supply container, the operation of moving the developer supply container to the mounting and demounting position, can be accomplished with a simple structure while the usability is improved, without upsizing of apparatus or cost increase.

While the invention has been described with reference to the structures disclosed herein, it is not confined to the details set forth and this application is intended to cover such modifications or changes as may come within the purpose of the improvements or the scope of the following claims.

What is claimed is:

1. A developer supply apparatus comprising:

a holding member for detachably holding a developer supply container having a developer discharge opening and a sealing member for sealing the developer discharge opening, wherein said holding member rotatably holds the developer supply container;

a manually rotatable member having a rotational axis and being disposed so as to be rotatable about a rotational axis of the developer supply container;

a converting mechanism, provided at a connecting portion between said rotatable member and said holding member, for converting a rotation of said rotatable member to a sliding operation of said holding member, and a locking member for locking engagement with the sealing member, wherein the sealing member moves from a closing position to an opening position by the sliding operation, and wherein the sliding operation includes a sliding movement for locking the sealing member with said locking member and a sliding movement for a relative movement of a main body of the developer supply container and the sealing member locked with said locking member causes the sealing member and said locking member to move away from each other.

2. An apparatus according to claim 1, wherein the sliding movements are continuously effected by a rotating operation in one rotational direction.

3. An apparatus according to claim 1, further comprising a driving portion for rotating the developer supply container to discharge the developer through the developer discharge opening after completion of the sliding operation.

4. An apparatus according to claim 1, wherein the sealing member moves from the opening position to the closing position by a sliding operation for closing the developer discharge opening.

5. An apparatus according to claim 1, wherein the sliding operation further includes a sliding movement for closing the developer discharge opening by fitting the sealing member locked with said locking member into the developer discharge opening, and a sliding movement for a relative moment between a main body of said developer supply container in which the sealing member is fitted and said locking member causes the sealing member and said locking member to move away from each other.

6. An apparatus according to claim 5, wherein the sliding movements are continuously effected by a rotating operation in one rotational direction.

7. An apparatus according to claim 6, further comprising a releasing member actable on the sealing member to release the sealing member from said locking member, and a release converting mechanism, provided at a connecting portion between said rotatable member and said releasing member, for converting a rotation of said rotatable member to a sliding operation of said releasing member.

8. An apparatus according to claim 7, wherein said release converting mechanism effects the sliding operation of said releasing member to release the sealing member from said locking member after completion of the sliding movement for fitting the sealing member locked with said locking member into the developer discharge opening, by rotation of said rotatable member for the sliding operation for closing the developer discharge opening.

9. An apparatus according to claim 8, wherein said release converting mechanism includes an engaging portion provided in said rotatable member and a projection, provided in said releasing member, for engagement with said engaging portion, and the rotational movement of said rotatable member is converted into the sliding operation of said releasing member by said projection being driven by said engaging portion.

10. A developer supply apparatus comprising:

a holding member for detachably holding a developer supply container;

a rotatable member rotatably supported on said holding member; and a converting mechanism, provided at a connecting portion between said rotatable member and said holding member, for converting a rotational movement of said rotatable member to a sliding operation of said holding member, wherein said rotatable member is rotatable around the developer supply container held on said holding member and is provided on a peripheral surface thereof with a grip portion for receiving a rotating force.

11. An apparatus according to claim 10, wherein the developer supply container held on said holding member is movable by a sliding operation between a position where the developer supply container is exchangeable and the position where the developer supply is enabled.

* * * * *

UNITED STATES PATENT AND TRADEMARK OFFICE

CERTIFICATE OF CORRECTION

PATENT NO. : 6,952,549 B2
DATED : October 4, 2005
INVENTOR(S) : Takayuki Kato et al.

It is certified that error appears in the above-identified patent and that said Letters Patent is hereby corrected as shown below:

Column 1,
Line 44, “One” should read -- On one --.

Column 2,
Line 59, “to” should read -- on --;
Line 60, “apparatus” should read -- the apparatus --;
Line 63, “the” should be deleted; and
Line 67, “touch,” should read -- touches, --.

Column 3,
Line 56, “7(C)” should read -- 7(C) show --.

Column 4,
Line 50, “leasing” should read -- leading --; and
Line 59, “have” should read -- has --.

Column 5,
Line 32, “20 o” should read -- 20 of --; and
Line 54, “Is” should read -- is --.

Column 6,
Line 20, “supply is possible,” should read -- supply --; and
Line 23, “position.” should read -- position is possible. --.

Column 7,
Line 46, “a” should read -- an --.

UNITED STATES PATENT AND TRADEMARK OFFICE

CERTIFICATE OF CORRECTION

PATENT NO. : 6,952,549 B2
DATED : October 4, 2005
INVENTOR(S) : Takayuki Kato et al.

It is certified that error appears in the above-identified patent and that said Letters Patent is hereby corrected as shown below:

Column 8,
Line 30, “an” should read -- a --;
Line 33, “by” should be deleted;
Line 40, “members” should read -- member --;
Line 43, “the necessity” should read -- there is no necessity --; and
Line 53, “as” should read -- is --.

Signed and Sealed this

Fourteenth Day of March, 2006

JON W. DUDAS
*Director of the United States Patent and Trademark Office*